US006010116A

United States Patent [19]

Knott, Sr.

[11] Patent Number: 6,010,116

[45] Date of Patent: Jan. 4, 2000

[54] HIGH SECURITY FENCE ASSEMBLY

[76] Inventor: James M. Knott, Sr., 456 Hill St., Whitinsville, Mass. 01588

[21] Appl. No.: 08/970,354

[22] Filed: Nov. 14, 1997

[51] Int. Cl.[7] ..... B21F 27/00

[52] U.S. Cl. ..... 256/47; 256/54; 256/24; 256/73

[58] Field of Search ..... 256/1, 11, 47, 256/48, 49, 52, 54, 55, 56, 57, 65, 68, 69, 70, 24, 73

[56] References Cited

U.S. PATENT DOCUMENTS

| | | | |
|---|---|---|---|
| 3,930,637 | 1/1976 | Davis . | |
| 4,673,166 | 6/1987 | MacDougall . | |
| 4,792,122 | 12/1988 | Smrt | 256/54 X |
| 4,910,933 | 3/1990 | Schwarzfeller et al. | 256/47 |
| 5,409,196 | 4/1995 | Specht . | |
| 5,542,649 | 8/1996 | Allegaert et al. . | |
| 5,556,080 | 9/1996 | Vise | 256/54 X |

FOREIGN PATENT DOCUMENTS

| | | |
|---|---|---|
| 359 346 | 3/1990 | European Pat. Off. . |
| 2 645 905 | 4/1978 | Germany . |
| 3 248 438 | 7/1984 | Germany . |
| 3 925 052 | 2/1991 | Germany . |

*Primary Examiner*—Terry Lee Melius
*Assistant Examiner*—William L. Miller
*Attorney, Agent, or Firm*—John E. Toupal; Harold G. Jarcho

[57] ABSTRACT

A high security fence and post assembly including a T-section post for installation in the ground and having an elongated, upwardly extending first plate portion defining a front surface and a rear surface and an elongated second plate portion projecting transversely from a longitudinally extending section of the rear surface. Also included is a first wire fence panel having a plurality of substantially parallel, spaced apart first wire members and a plurality of substantially parallel, spaced apart second wire members transversely intersecting and attached to the first wire members, the first panel having at one edge a marginal portion overlaying at least a longitudinally extending portion of the front surface; and a second wire fence panel having a plurality of substantially parallel, spaced apart first wire members and a plurality of substantially parallel, spaced apart second wire members intersecting and attached to the first wire members, the second panel having at one edge a marginal portion overlaying at least a longitudinally extending surface portion of the front surface. An elongated plate member overlays the front surface and together therewith straddles the marginal portions of the first and second fence panels; and a securing mechanism secures the plate member to the front surface so as to compress the marginal portions between the plate member and the front first surface.

18 Claims, 2 Drawing Sheets

HIGH SECURITY FENCE ASSEMBLY

BACKGROUND OF THE INVENTION

This invention relates generally to fence structures and, more particularly, to fence structures for enclosing areas requiring high security.

High security fences are used extensively around confinement areas, prisons, and the like. Such fences also are frequently provided to exclude persons from areas for both the protection of the person, as at construction sites, and for protection of the site itself, as at industrial sites, secret installations, and even homes or residential areas.

Typically, high security fence consists of multiple vertical posts projecting upward from a stable support base such as the ground. The posts support paneling or partitions which in the most common form consist of a continuous length of wire mesh. Such basic fences, while providing a barrier against any casual desire to move from one side of the fence to the other, do provide ready handholds and footholds and can be easily scaled by a determined person.

In attempts to enhance the effectiveness of such fences, angled extensions of barbed wire are mounted to the upper ends of the posts to extend upwardly and inwardly toward one side of the fence. Such extensions are normally relatively short and permit access by a person having both a handhold and a foothold on the vertical fence itself. As such, the portion of the barrier which provides the maximum effectiveness, when considering a person of reasonable agility, is at the extreme top of the fence.

An improved high security fence is disclosed in U.S. Pat. No. 4,673,166. The fence disclosed therein includes fence posts that angle inwardly toward the side of the fence to which a person is to be confined. The inward angling of the fence posts and retained wire mesh is effected by utilizing fence posts anchored to project vertically upwardly from the ground to a predetermined height from which they arcuately arch upwardly and laterally from the vertically positioned and anchored lower end portion.

Because of the "overhang" nature of the fence throughout at least the major portion of the height thereof, the establishment of a foothold is precluded. Although improving security the angled fence disclosed in the patent exhibits various disadvantages such as high cost and labor intensive installation requirements.

The object of this invention, therefore, is to provide an improved high security fence which entails simplified relatively low cost assembly.

SUMMARY OF THE INVENTION

The invention is a high security fence and post assembly including a T-section post for installation in the ground and having an elongated, upwardly extending first plate portion defining a front surface and a rear surface and an elongated second plate portion projecting transversely from a longitudinally extending section of the rear surface. Also included is a first wire fence panel having a plurality of substantially parallel, spaced apart first wire members and a plurality of substantially parallel, spaced apart second wire members transversely intersecting and attached to the first wire members, the first panel having at one edge a marginal portion overlaying at least a longitudinally extending portion of the front surface; and a second wire fence panel having a plurality of substantially parallel, spaced apart first wire members and a plurality of substantially parallel, spaced apart second wire members intersecting and attached to the first wire members, the second panel having at one edge a marginal portion overlaying at least a longitudinally extending surface portion of the front surface. An elongated plate member overlays the front surface and together therewith straddles the marginal portions of the first and second fence panels; and a securing mechanism secures the plate member to the front surface so as to compress the marginal portions between the plate member and the front first surface. The configuration of the assembly greatly simplifies joining of the post and fence panels and enhances rigidity and strength thereof.

According to one feature of the invention, the first plurality of wire members are welded to the second plurality of wire members. The welded wires enhance the security provided by the assembly.

According to other features of the invention, the first and second wire members form substantially rectangular and uniformly sized interstices having a first dimension D substantially greater than a second dimension d and, preferably, the second dimension is less than ½ inch and the first dimension is greater than 2 inches. Security is further enhanced by the limited interstice dimensions which restrict access of human limbs or bolt cutters.

According to still other features of the invention, the securing mechanism includes a plurality of longitudinally distributed first threaded members extending between the plate member and a longitudinally extending first surface portion of the front surface, and a plurality of longitudinally distributed second threaded members extending between the plate member and a longitudinally extending second surface portion of the front surface. The threaded member simplify the construction of fence sections employing the post and panel assemblies.

According to yet another feature of the invention, each of the first and second members is a self-tapping stud extending through an opening in the plate member and threadedly engaging an opening in the first plate portion. Fence construction is further simplified by this feature.

According to a further feature, the invention includes a first retainer wire disposed between the first edge member and the securing members, and a second retainer wire disposed between the second edge member and the securing members. The retainer wire enhances security by preventing forced shearing of the welds on the wire edge members of the fence panels.

According to an additional feature of the invention, the T-section post is shaped and arranged to have an upper end substantially horizontally displaced from a bottom end. The resultant overhang of the fence panels restricts climbing access to their upper edges.

According to an important feature of the invention, the marginal portions of the first and second fence panels are overlapped between the front surface of the post and the plate member. This feature enhances strength, rigidity and security of the assembly.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
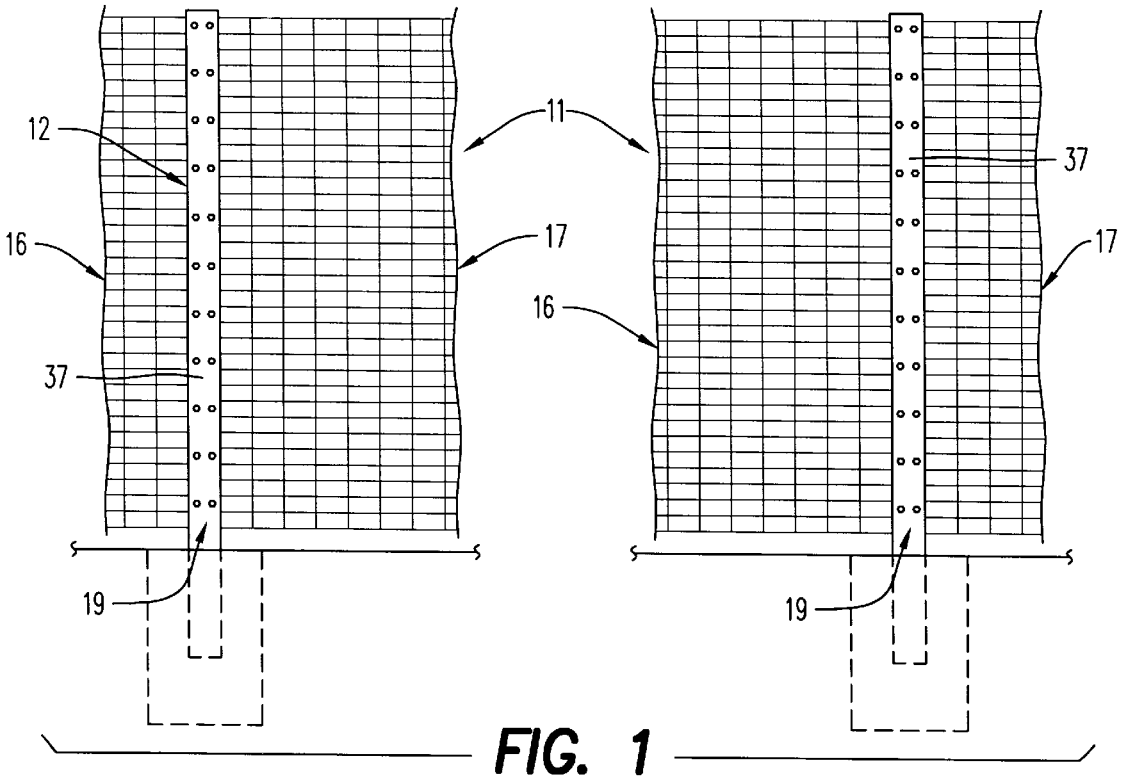
FIG. 1 is a front elevational view of a security fence according to the invention.
Figure 2:
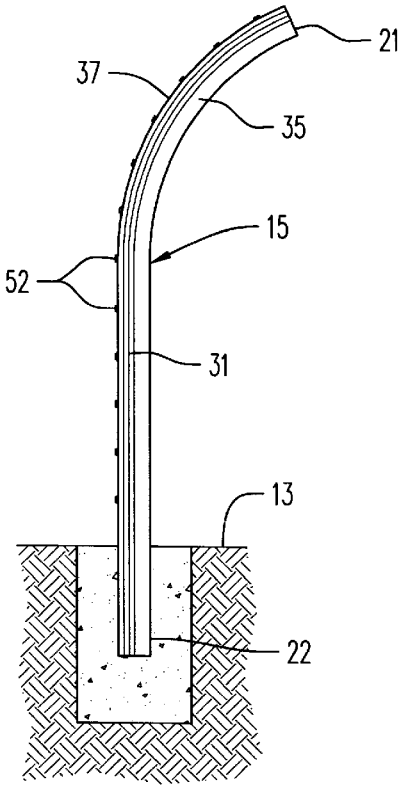
FIG. 2 is a side elevational view of a post used in the fence shown in FIG. 1.

A high security fence 11 is formed by a plurality of horizontally distributed fence and post assemblies 12 extending above a ground surface 13 (FIG. 1). Each assembly includes a T-section post 15 and first and second wire fence panels 16, 17. In each assembly 12, the first and second fence panels 16, 17 are attached to the T-section post 15 by a securing mechanism 19. The T-section posts 15 are curved (FIG. 2) so as to have an upper ends 21 substantially horizontally displaced from bottom ends 22 embedded in the ground surface 13. To preserve clarity in FIG. 2, the fence panels 16, 17 are not shown.

Figure 3:
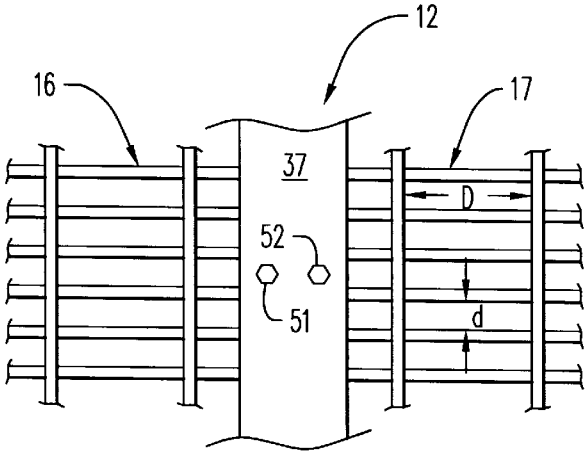
FIG. 3 is a detailed, partial front view of a fence and post assembly of the fence shown in FIG. 1.
Figure 4:
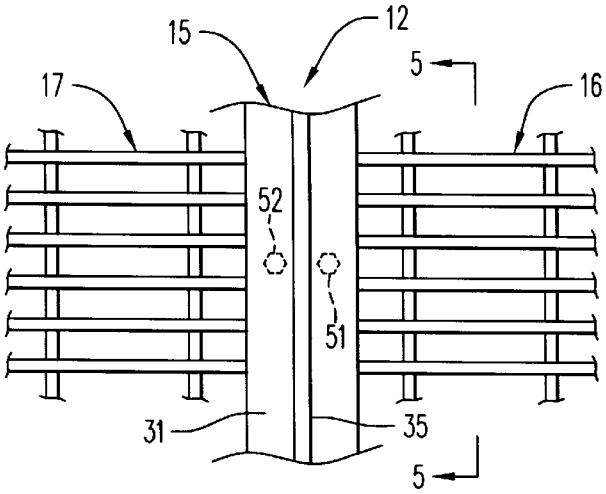
FIG. 4 is a rear view of the assembly shown in FIG. 3.
Figure 5:
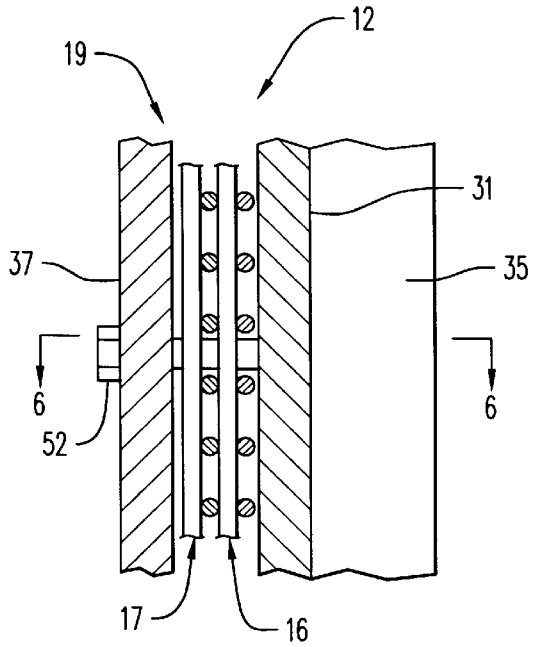
FIG. 5 is a cross sectional view taken along lines 5—5 of FIG. 4.

Each of the fence panels 16, 17 is formed by a plurality of parallel, vertical and spaced apart first wire members 24 and a plurality of horizontal, parallel and spaced apart second wire members 25 transversely intersecting and attached to the first wire members 24. Preferably, the intersections of the first and second wire members 24, 25 are attached by a welding process. As shown in FIG. 3, the first and second wire members 24, 25 form uniformly sized rectangular interstices having a horizontal first dimension D substantially greater than a vertical second dimension d. The first dimension D preferably is greater than 2½ inches and the second dimension d is less than ½ inch and in a particularly preferred embodiment, the first dimension D is approximately 2.84 inches and the second dimension d is approximately ⅓ inch. In addition, the first and second wires 24, 25 are dimensioned to have a gauge of at least 6 and, preferably, 8 or greater.

Figure 6:
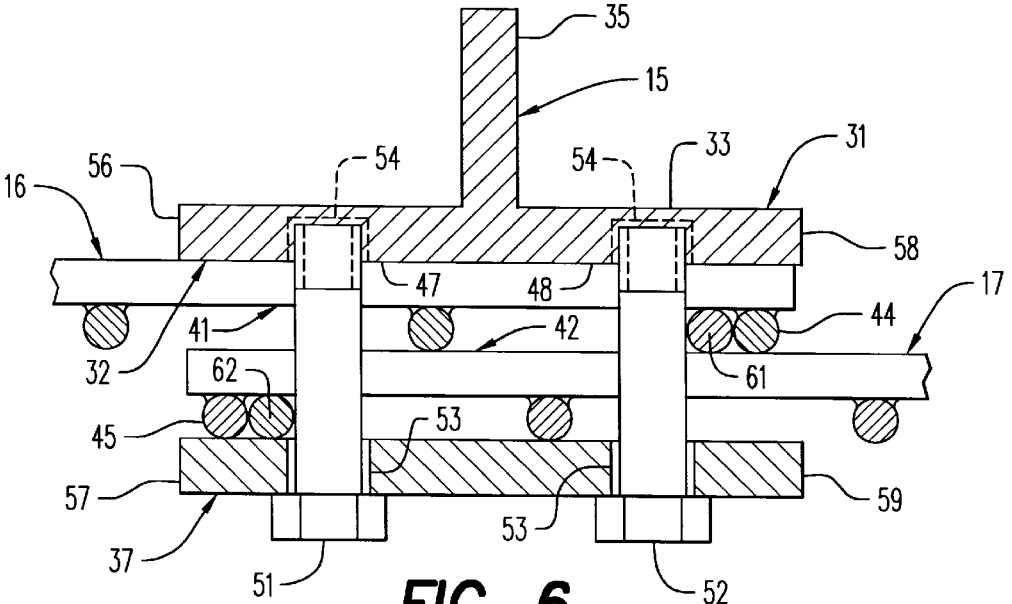
FIG. 6 is a cross sectional view taken along lines 6—6 of FIG. 5.

The T-section post 15 (FIG. 6) includes an elongated upwardly extending first plate portion 31 defining a front surface 32 and a rear surface 33, and an elongated second plate portion 35 projecting transversely from a longitudinally extending mid-section of the first plate portion 31. Also included in the securing mechanism 19 of each assembly 12 is an elongated plate member 37 overlaying the front surface 32 of the first plate portion 31 and together therewith straddling, respectively, adjacent overlapped marginal portions 41, 42 of the first and second fence panels 16, 17. Forming the edges of the marginal portions 41, 42 are, respectively, first and second edge members 44, 45 of the first vertically oriented wires 24. The overlapped marginal portions 41 and 42 of the first and second fence panels 16, 17 overlay the front surface 32 of the first plate portion 31.

Also included in the securing mechanism 19 are a longitudinally distributed plurality of threaded first stud members 51 extending between the plate member 37 and a longitudinally extending first surface portion 47 of the front surface 32 and a longitudinally distributed plurality of threaded second stud members 52 extending between the plate member 37 and a longitudinally extending second surface portion 48 of the front surface 32. Each of the self-tapping studs 51, 52 extends through an opening 53 in the plate member 37 and threadedly engages an opening 54 in the first plate portion 31 of the T-section post 15. The second stud members 52 are disposed between the first wire edge member 44 of the first fence panel 16 and longitudinal first edges 56, 57 of, respectively, the first plate portion 31 and the plate member 37. Similarly, the first stud members 51 are disposed between the second wire edge member 45 of the second fence panel 17 and second longitudinal edges 58, 59 of, respectively, the first plate portion 31 and the plate member 37. A vertically oriented first retainer wire 61 is positioned between the first wire edge member 44 of the first fence panel 16 and the second stud members 52 and a vertically oriented second retainer wire 62 is positioned between the second wire edge member 45 of the second fence panel 17 and the first stud members 51. The retainer wires 61 and 62 longitudinally distribute any lateral force applied to the fence panels 16, 17 and thereby prevent shearing of the welds on the wire edge members 44, 45 during any attempt to withdraw the panels from the assembly 12.

During assembly of the security fence 11, the T-section posts 15 are embedded in the ground 13 along a perimeter of an area A (FIG. 2) to be secured. The spacing between the T-section posts 15 is determined by the lengths of the first and second fence panels 16, 17. At each assembly 12, marginal portions 41, 42 of the fence panels 16, 17 are positioned over the front surface 32 in an overlapped, juxtaposed relationship. Next, the first and second retainer wires 61, 62 are located adjacent to, respectively, the first and second wire edge members 44, 45 and the elongated plate member 37 is placed over the overlapped marginal portions 41, 42 of the first and second fence panels 16, 17. During placement, the openings 53 in the plate member 37 are aligned with the openings 54 in the first plate portion 31 of the T-section post 15. Finally, the first and second stud members 51 and 52 are inserted through the openings 53 in the plate member 37 and tapped into the openings 54 in the first plate portion 31. The stud members 51, 52 are tightened against the plate member 37 to compress the marginal portions 41, 42 of the first and second fence panels 16, 17 between the plate member 37 and the front surface 32 of the first plate portion 31. Because of the significant mass provided by the overlapped marginal portions 41, 42, the rigidity and strength of each assembly 12 is enhanced allowing a reduction in the thickness required for the first and second plate portions 31, 35 of each T-section post 15.

After assembly, the fence 11 establishes a high degree of security for the secured area A. Because of the inward curvature of the T-section posts 15, climbing access to the top edges of the fence panels 16, 17 is severely restricted. Climbing of the fence panels 16, 17 is restricted further by the narrow dimension d of the interstices 27 which prevent access of a climber's limbs. A further security feature of the narrow dimension d of the interstices 27 is an ability to prevent the access of bolt cutters of a size sufficient to sever the heavy gauge metal wires 24, 25.

Obviously, many modifications and variations of the present invention are possible in light of the above teachings. It is to be understood, therefore, that the invention can be practiced otherwise than as specifically described.

What is claimed is:

1. A high security fence and post assembly comprising:

a T-section post for installation in the ground; said post comprising an elongated, upwardly extending first plate portion defining a front surface and a rear surface and an elongated second plate portion projecting transversely from a longitudinally extending section of said rear surface;

a first wire fence panel having a plurality of interstices formed by a plurality of substantially parallel, spaced apart first wire members and a plurality of substantially parallel, spaced apart second wire members transversely intersecting and attached to said first wire members; said first panel having at one edge a marginal portion overlaying at least a longitudinally extending portion of said front surface;

a second wire fence panel having a plurality of interstices formed by a plurality of substantially parallel, spaced apart first wire members and a plurality of substantially parallel, spaced apart second wire members intersecting and attached to said first wire members; said second panel having at one edge a marginal portion overlaying at least a longitudinally extending portion of said front surface;

plate overlay means overlaying said front surface and together therewith straddling said marginal portions of said first and second fence panels;

a plurality of first securing members fixed between said post and said overlay means, each said first securing member extending through a different said interstice in said first wire fence panel; and a plurality of second securing members fixed between said post and said overlay means; each said second securing member extending through a different said interstice in said second wire fence panel; and wherein said first and second securing members compress said marginal portions of said first and second fence panels between said overlay means and said front surface.

2. An assembly according to claim 1 wherein each of said first and second securing members are spaced apart along substantially the full length of said post.

3. An assembly according to claim 2 wherein said plurality of first wire members are welded to said plurality of second wire members.

4. An assembly according to claim 3 wherein said interstices formed by said first and second wire members form substantially rectangular and uniformly sized interstices having a first dimension D substantially greater than a second dimension d.

5. An assembly according to claim 4 wherein said second dimension d is less than ½ inch.

6. An assembly according to claim 5 wherein said second dimension d is approximately ⅓ inch and said first dimension D is approximately 3 inches.

7. An assembly according to claim 2 wherein said first and second securing members comprise a plurality of longitudinally distributed first threaded members extending between said overlay means and a longitudinally extending first surface portion of said front surface, and a plurality of longitudinally distributed second threaded members extending between said overlay means and a longitudinally extending second surface portion of said front surface, said first surface portion adjoining said second surface portion.

8. An assembly according to claim 7 wherein each of said first and second securing members is a self-tapping stud extending through an opening in said overlay means and threadedly engaging an opening in said front surface.

9. An assembly according to claim 2 including a first retainer wire disposed between said one edge of said first panel and said securing members, and a second retainer wire disposed between said one edge of said second panel and said securing members.

10. An assembly according to claim 1 wherein said marginal portions of said first and second fence panels are overlapped between said front surface and said plate member.

11. An assembly according to claim 10 wherein each of said first and second securing members are spaced apart along substantially the full length of said post.

12. An assembly according to claim 11 wherein said plurality of first wire members are welded to said plurality of second wire members.

13. An assembly according to claim 12 wherein said interstics formed by said first and second wire members form substantially rectangular and uniformly sized interstices having a first dimension D substantially greater than a second dimension d.

14. An assembly according to claim 13 wherein said second dimension d is less than ½ inch.

15. An assembly according to claim 10 wherein said T-section post is shaped and arranged to have an upper end substantially horizontally displaced from a bottom end.

16. An assembly according to claim 10 wherein said marginal portions are in direct contact with said front surface.

17. An assembly according to claim 1 wherein said T-section post is shaped and arranged to have an upper end substantially horizontally displaced from a bottom end.

18. An assembly according to claim 1 wherein said marginal portions are in direct contact with said front surface.

* * * * *